US007802346B2

(12) United States Patent
Breuer et al.

(10) Patent No.: US 7,802,346 B2
(45) Date of Patent: Sep. 28, 2010

(54) ARRANGEMENT FOR RECOGNIZING UNDESIRABLE PARTICLES IN TEXTILE FIBRE MATERIAL

(75) Inventors: Achim Breuer, Aachen (DE); Christoph Färber, Korschenbroich (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 195 days.

(21) Appl. No.: 12/153,238

(22) Filed: May 15, 2008

(65) Prior Publication Data

US 2008/0301911 A1 Dec. 11, 2008

(30) Foreign Application Priority Data

Jun. 5, 2007 (DE) ..... 10 2007 026 464

(51) Int. Cl.
*D01G 21/00* (2006.01)

(52) U.S. Cl. ..... 19/65 A; 19/65 R

(58) Field of Classification Search ..... 19/65 A, 19/65 R; 73/159; 356/238.3
See application file for complete search history.

(56) References Cited

U.S. PATENT DOCUMENTS

| | | | | |
|---|---|---|---|---|
| 5,822,972 | A | 10/1998 | Patelke et al. | |
| 7,093,325 | B2 * | 8/2006 | Breuer et al. | 19/66 CC |
| 2004/0177479 | A1 * | 9/2004 | Breuer et al. | 19/65 A |

FOREIGN PATENT DOCUMENTS

| | | | |
|---|---|---|---|
| DE | 39 28 279 | A1 | 2/1991 |
| DE | 202 02 780 | U1 | 6/2002 |
| DE | 101 32 711 | A1 | 1/2003 |
| DE | 196 51 893 | B4 | 10/2006 |
| EP | 13 00 493 | A1 | 10/2001 |
| GB | 2 399 352 | A | 9/2004 |

OTHER PUBLICATIONS

German Patent and Trademark Office Search Report, dated Dec. 18, 2007, issued in connection with counterpart German Application No. 10 2007 026 464.1.

UK Intellectual Property Office Search Report, dated Aug. 13, 2008, issued in connection with counterpart British Application No. GB0809943.4.

* cited by examiner

*Primary Examiner*—Shaun R Hurley
(74) *Attorney, Agent, or Firm*—Venable LLP; Robert Kinberg; Ryan M. Flandro

(57) ABSTRACT

In a device for identifying undesirable particles in textile fibre material, especially on spinning preparation machines, in which the detection of the undesirable particles is effected by optoelectronic means, the fibre material can be detected by a recognition device and the measurement results can be supplied to an image-processing device. In order substantially to improve evaluation of the measurement of the undesirable particles, there is a combing-out element for at least one fibre sliver, with which a fibre tuft having open ends in the working direction and a fibre tuft having open ends opposite to the working direction can be produced. The measured values of undesirable particles at both fibre tufts can be supplied to a comparison device and the comparison values can be used for optimising setting parameters and/or structural elements of the spinning preparation machines.

19 Claims, 3 Drawing Sheets

ARRANGEMENT FOR RECOGNIZING UNDESIRABLE PARTICLES IN TEXTILE FIBRE MATERIAL

CROSS REFERENCE TO RELATED APPLICATION

This application claims priority from German Patent Application No. 10 2007 026 464.1 dated Jun. 5, 2007, the entire disclosure of which is incorporated herein by reference.

BACKGROUND OF THE INVENTION

The invention relates to an arrangement for recognizing undesirable particles, especially trash particles, neps, husk neps, burls and the like, in textile fibre material, for example cotton, synthetic fibres and the like, especially on spinning preparation machines, in which the detection of the undesirable particles is effected by optoelectronic means, the fibre material being detectable by a recognition device and the measurement results being supplied to an image-processing device.

In a known arrangement (DE 39 28 279 A), a fibre web is formed in which the fibres are connected with one another in the form of a web. The fibre web is moved in one direction, a sensor registering each undesirable particle stepwise. Because the web is a closed structure and is being moved in only one direction during the detection, it is possible to obtain information as to the nature and amount of the undesirable particles, but not a differentiated view in respect of the processing of the fibre material on the spinning preparation machine.

SUMMARY OF THE INVENTION

It is an aim of the invention to improve such an arrangement so that evaluation of the measurement of the undesirable particles is considerably improved.

The invention provides an apparatus for recognizing undesirable particles in textile fibre material processed on one or more textile machines, comprising:

a combing-out device for at least one fibre sliver length, with which a fibre tuft having open ends in the working direction and a fibre tuft having open ends opposite to the working direction can be produced;

a recognition device for detecting undesirable particles; and a comparison device;

wherein the measured values of the undesirable particles obtained at both fibre tufts are supplied to the comparison device and comparison values are used for optimizing setting parameters and/or structural elements of the textile machine or machines.

By means of the arrangement according to the invention, the undesirable particles at two fibre tufts can be detected and compared with one another, the fibre tufts reflecting opposite working directions in the production of the fibre sliver. As a result, it is advantageously made possible to obtain information relating to the setting parameters and/or working elements of the spinning preparation machines, for example a carding machine. In accordance with a further advantage, those setting parameters are used for optimizing the spinning preparation machine and the processing process.

Accordingly, nep detection at the fibre tuft has the particular advantage over nep detection at the web that a differentiated view is possible which allows causal association with different working elements of the carding machine. It is thus possible for the nep count result of a carding machine, when it is above the individually determined warning limit, to be translated directly into a quite purposive optimization of the machine settings or of the clothings used or into purposive maintenance measures, such as, for example, exchanging the fixed carding elements or grinding the card top and/or drum clothing, and to be presented as instructions for specific action.

Advantageously, the recognition device is an optoelectronic device. The optoelectronic device may advantageously have a camera, for example a diode line camera. Advantageously, the arrangement has an electronic evaluating device, for example, an image-processing unit. Advantageously, the apparatus has a computer. Preferably, the apparatus has an evaluating device with a comparison device for the electrical pulses of the measuring device.

The apparatus is advantageously associated with one or more spinning preparation machines. Preferably, the apparatus is associated with a fibre-sliver-forming device, for example a carding machine.

The recognition device is advantageously arranged to detect neps. Advantageously, undesirable particle recognition, especially nep detection, is effected on the basis of the image-processing at the fibre tuft according to the number, shape and size of the neps. Advantageously, neps and other undesirable particles, for example pieces of husk with adhering fibres, leaf and stem residues, are detectable separately on both sides of the fibre tuft, that is to say in the machine working direction and in the opposite direction. Advantageously, the differences in the detection on both sides of the fibre tuft can be used for measured value analysis and/or fault location. For example, in certain embodiments the count results of each tuft side can be associated causally with the carding work of specific working elements. In some embodiments, the association is effected unambiguously. For example, the neps on the side of the fibre tuft having a predominant number of trailing hooks are to be associated essentially with the carding of the revolving card top regions. In certain preferred embodiments, the association may relate to one or more of the setting of the working elements, their clothing and their clothing's state of wear. In practice, the measurement results can be used, for example, as an instruction for action in respect of the working elements, for example an instruction to grind revolving card top clothing. Advantageously, the arrangement is such that, when a limit value is exceeded, warning messages in respect of the working elements can be displayed.

The invention also provides an apparatus for recognizing undesirable particles, especially trash particles, neps, husk neps, burls and the like, in textile fibre material, for example cotton, synthetic fibres and the like, especially on spinning preparation machines, in which the detection of the undesirable particles is effected by optoelectronic means, the fibre material being detected by a recognition device and the measurement results being supplied to an image-processing device, wherein there is a combing-out element for at least one fibre sliver with which a fibre tuft having open ends in the working direction and a fibre tuft having open ends opposite to the working direction can be produced, the measured values of the undesirable particles obtained at both fibre tufts being supplied to a comparison device and the comparison values being usable for optimizing setting parameters and/or structural elements of the spinning preparation machines.

DETAILED DESCRIPTION OF CERTAIN PREFERRED EMBODIMENTS

Figure 1:
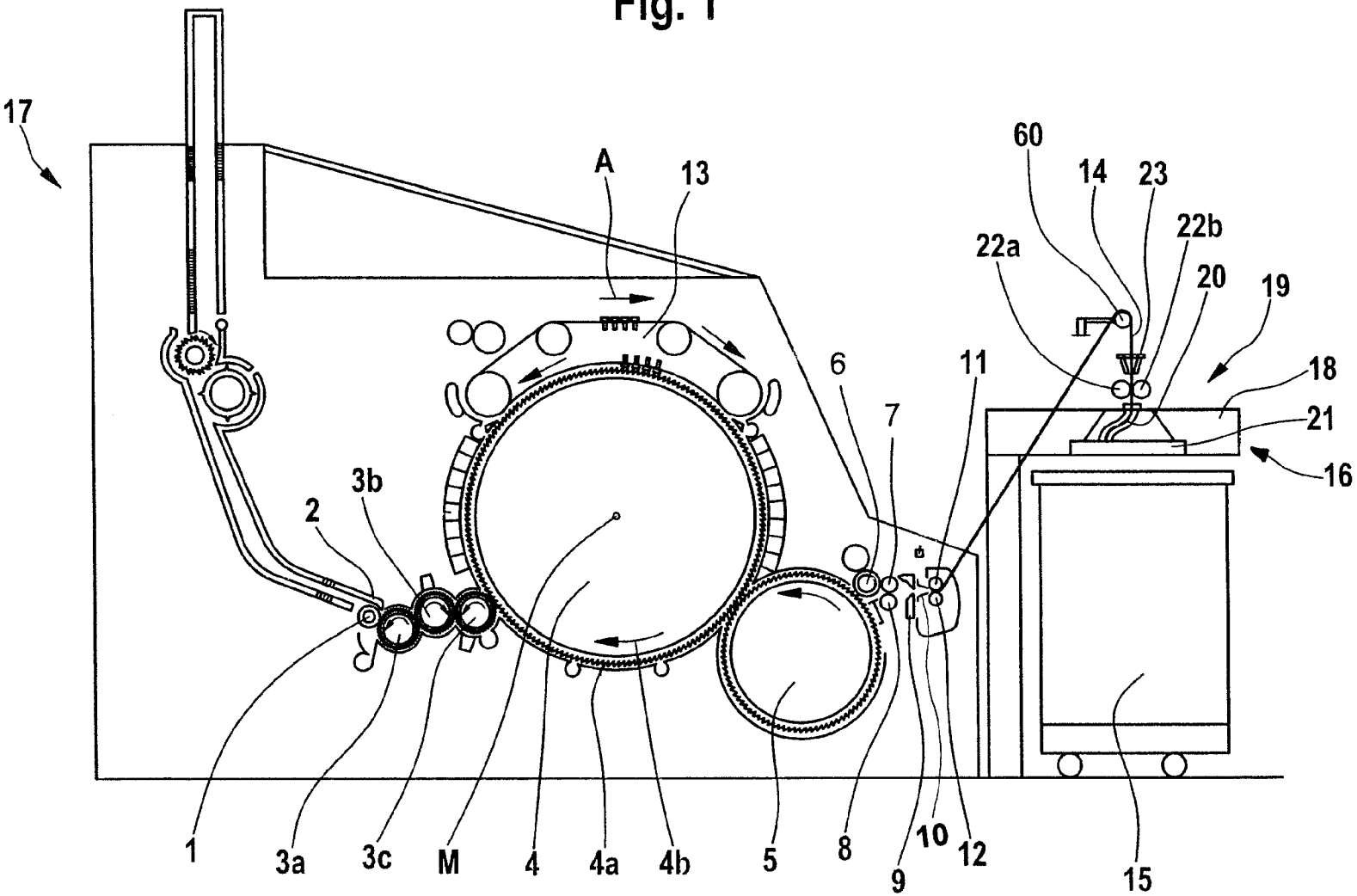
FIG. 1 is a diagrammatic side view of a carding machine having a web funnel and fibre sliver for application of an arrangement according to the invention.

With reference to FIG. 1, a carding machine, e.g. a TC 03 flat card made by Trützschler GmbH & Co. KG of Mönchenglandbach, Germany, has a feed roller 1, feed table 2, lickers-in 3*a*, 3*b*, 3*c*, cylinder 4, doffer 5, stripper roller 6, nip rollers 7, 8, web guide element 9, web funnel 10, delivery rollers 11, 12, revolving card top 13 with card top guide rollers and flats, can 15 and can coiler 16. A fibre bundle passes through the web funnel 10, the fibre bundle entering in the form of a fibre web (not shown) and emerging in the form of a card sliver 14. The directions of rotation of the rollers are indicated by curved arrows. Reference letter M denotes the centre point (axis) of the cylinder 4. Reference numeral 4*a* indicates the clothing and reference numeral 4*b* indicates the direction of rotation of the cylinder 4. Arrow A indicates the working direction. Upstream of the carding machine there is arranged a flock feed device 17. The coiler plate 19 is rotatably mounted in the coiler plate panel 18. The coiler plate 19 comprises a sliver channel 20 having an inlet and an outlet for fibre sliver 14 and a rotary plate 21. The fibre sliver 14 is guided over a guide roller 60 and is drawn through a sliver funnel 23 by delivery rollers 22*a*, 22*b* and then passes into and through the sliver channel 20.

Figure 2:
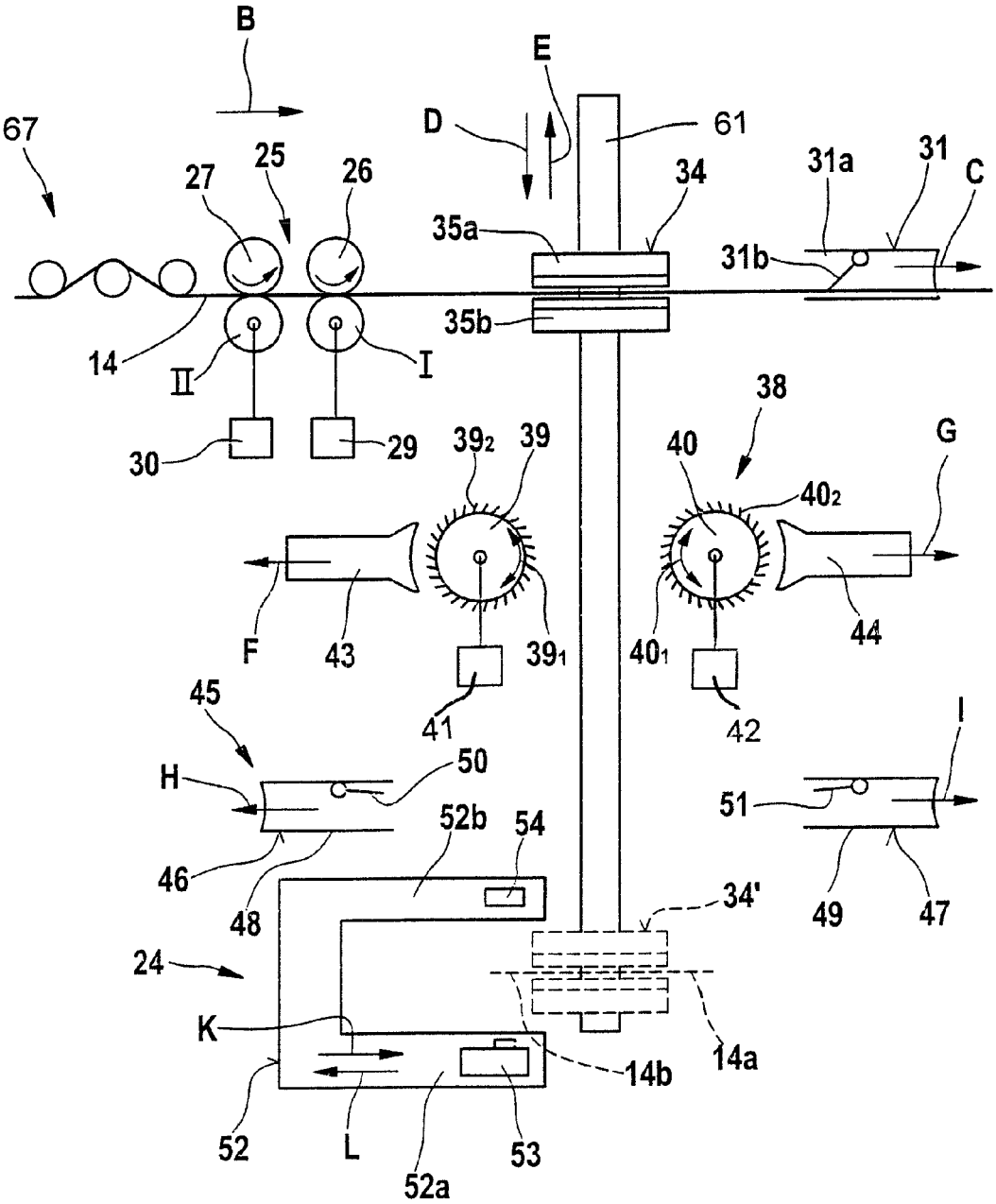
FIG. 2 is a diagrammatic side view of an arrangement according to the invention.

In the embodiment shown in FIG. 2, an arrangement for identifying undesirable particles in a fibre sliver 14 has a measuring, evaluating and display device 24. In addition, there is provided as conveyor device a drafting system 25, for example a 2-over-2 drafting system known per se, that is to say it consists of two lower rollers I, II (I output lower roller, II input lower roller) and two upper rollers 26, 27. In the drafting system 25, the fibre sliver 14 from the carding machine is drafted. The roller pairs 26/I and 27/II are driven by variable speed drive motors 29 and 30, respectively. The direction of rotation of the rollers I, II, 26 and 27 are indicated by curved arrows. Reference letter B indicates the working direction (running direction of the fibre sliver 14). Substantially in alignment with the nip lines between the roller pairs 26/I and 27/II there is arranged, spaced apart from the roller pair 26/I, a conveyor element 31 for conveying the fibre sliver 14 emerging from the output rollers 26/I. The conveyor element 31 is mounted and displaceable on two guide elements, for example rods, sliding guides, rails or the like. The conveyor element 31 comprises a suction tube 31*a* which is connected to a suction air source (not shown), which draws air through the suction tube 31*a* in direction C. In the end region of the suction tube 31*a* there is a clamping flap element 31*b* or the like, which is at one end rotatably mounted in a pivot bearing. The flap element is drivable by a drive element (not shown), for example a pneumatic cylinder or the like. In the closed position, the flap 31*b* clamps the fibre sliver 14 against the inner wall of the suction tube 31*a*. Likewise arranged substantially in alignment with and spaced apart from the output roller pair 26/I there is a clamping receiving device 34, which clamps the conveyed fibre sliver 14 and thereby holds or fixes it in place. The receiving device 34 also has two clamping elements 35*a*, 35*b*, for example clamping jaws or the like. The clamping jaw 35*a* is rotatably mounted on a pivot bearing, and on the clamping jaw 35*a* there is articulated one end of a pneumatic cylinder. The clamping jaws 35*a*, 35*b* form a structural assembly the position of which can be shifted as a unit (see arrows D, E). Substantially vertically below the receiving device 34 there is a combing device 38 (also referred to as a combing-out device) which comprises two combing rollers 39, 40, arranged axially parallel to one another, which are driven by two variable speed drive motors 41 and 42, respectively. The combing rollers 39 and 40 rotate slowly, for example at 20 rev/min, in the direction of arrows $\mathbf{39}_1$ and $\mathbf{40}_1$, respectively. The direction of rotation of the combing rollers 39, 40 is reversible so as to comb out the ends of the sliver length, fibre tufts 14*a*, 14*b*, from two sides. The combing rollers 39, 40 are clothed on their outer surfaces with combing clothings $\mathbf{39}_2$ and $\mathbf{40}_2$, respectively. On their respective remote outer sides, the combing rollers 39, 40 are associated with conveyor elements 43, 44 for removal in direction F and G, respectively, of the fibre material projecting beyond the fibre tufts 14*a*, 14*b*, especially of the fibre material combed out of the fibre tufts 14*a*, 14*b*, which conveyor elements are connected to suction air sources (not shown). Below the combing device 38 there is arranged a fibre alignment unit 45 which comprises two conveyor elements 46 and 47 which can be of substantially the same construction as the conveyor element 31. In that case, the conveyor elements 46 and 47 likewise each have a suction tube 48, 49, respectively, arranged coaxially with respect to one another. The input openings of the suction tubes 48, 49, which are associated with the hinged clamping flaps 50 and 51, respectively, face one another. The direction of the suction air currents is indicated by H and I. The conveyor elements 46, 47 serve for aligning the fibre tufts 14*a*, 14*b*, which are angled or curved upwards or downwards as a result of the direction of rotation $\mathbf{39}_1$, $\mathbf{39}_2$ of the combing rollers 39, 40. Below the fibre alignment unit 45 there is arranged the measuring device 24. The measuring device comprises a holding device 52 which is displaceable in the direction of arrows K, L. The holding device 52 is of approximately U-shaped construction in cross-section, a camera 53 being arranged in the limb 52*a* and an illumination device 54, for example a lamp, being arranged—opposite and spaced apart from the camera 53—in the limb 52*b*. The holding device 52, together with the camera 53 and the illumination device 54, is movable in the direction of arrows K, L so that the fibre tufts 14*a*, 14*b* located between the camera 53 and the illumination device—i.e. between the limbs 52*a* and 52*b*—and projecting outwards beyond the fixed receiving device 34' (shown in dotted lines) can be detected. In order to convey the fibre sliver 14 from the level of the drafting system 25 and of the conveyor element 31 substantially vertically from the top to the bottom with the aid of the receiving device 34 by way of the combing-out device 38 and the fibre alignment device 45 to the measuring device 24, a vertical guide element 61, for example a rod, sliding guide, rail or the like, is provided. The position of the receiving device 34 can be shifted, for example by sliding, along the guide element 61 in the direction of arrows D, E, holding devices (not shown), for example locking devices, being provided at the level of the elements 38, 45 and 23. Reference numeral 67 denotes a fibre sliver intake arrangement.

Figure 3:
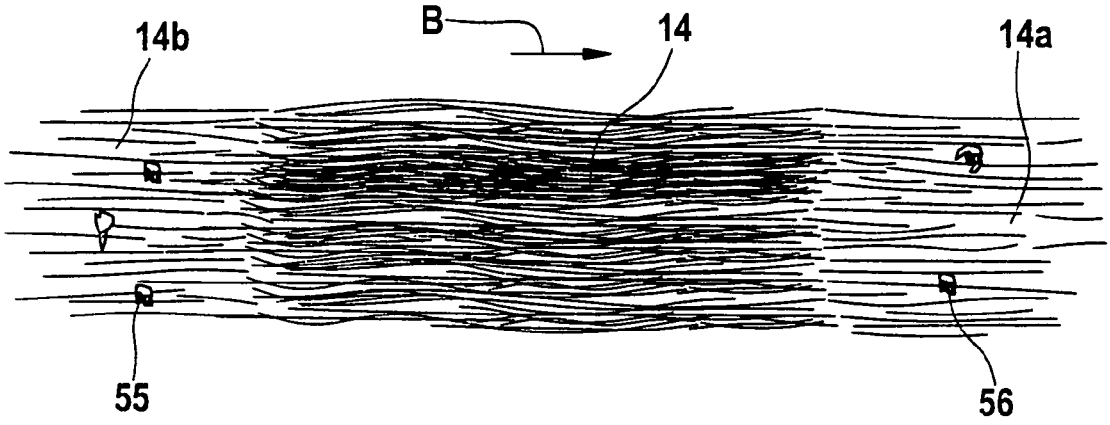
FIG. 3 is a plan view of a drafted fibre sliver with a fibre tuft at each of the two open ends containing undesirable particles.

With reference to FIG. 3, at each of the two free ends of the fibre sliver length 14 there is a combed-out fibre sliver 14*a* and 14*b*. The fibre slivers 14*a* and 14*b* contain neps 55 and 56, respectively, which appear dark, possibly black, as a result of the transmitted light.

Figure 4:
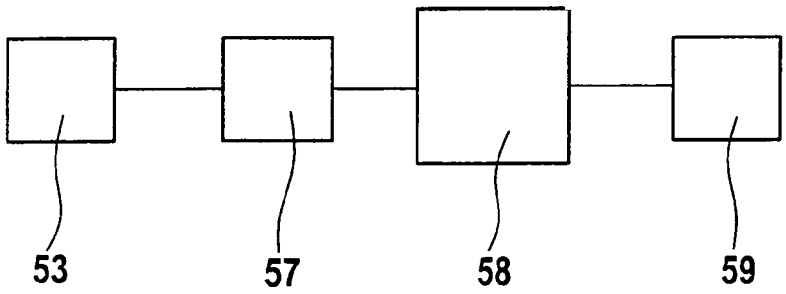
FIG. 4 is a diagrammatic block circuit diagram showing a camera, evaluating device, electronic control and regulation device (computer) and comparison device.

In the embodiment of FIG. 4, the camera 53 is connected by way of an image-processing device 57 to an electronic control and regulation device 58, for example with a microcomputer, to which a comparison device 59 is also connected.

In use, a length of fibre web is detached by clamping receiving device 34, and lowered whilst still clamped in device 34 to combing device 38. The ends 14*a*, 14*b* of the sliver length (see FIG. 3) are combed by respective combing rollers 39, 40, with removed fibre being withdrawn by suction through conveyor devices 43, 44. The sliver length is then lowered to be level with measuring device 24. The combed tuft 14*b* is examined using the camera 53 and illumination device 54. The device 24 is then displaced in the direction of arrow K to examine the combed tuft 14*a*. The data is analyzed. For example, the measurements at the fibre tufts 14*a*, 14*b* can be compared. The setting parameters of the spinning preparation machine may be adjusted in dependence upon the measurements.

Although the foregoing invention has been described in detail by way of illustration and example for purposes of understanding, it will be obvious that changes and modifications may be practiced within the scope of the appended claims.

What is claimed is:

1. An apparatus for recognizing undesirable particles in textile fibre material processed on one or more textile machines, comprising:

a combing-out device for at least one fibre sliver length, the combing-out device arranged to produce a fibre tuft having open ends in the working direction and a fibre tuft having open ends opposite to the working direction;

a recognition device for detecting undesirable particles; and a comparison device, wherein measured values of the detected undesirable particles obtained by the recognition device at the open ends of both fibre tufts are supplied to the comparison device and comparison values are used for optimizing setting parameters and/or structural elements of the one or more textile machines.

2. An apparatus according to claim 1, in which the recognition device is an optoelectronic device.

3. An apparatus according to claim 2, in which the recognition device is a camera.

4. An apparatus according to claim 1, in which the recognition device is arranged to generate electrical signals representing the measured values of the detected undesirable particles.

5. An apparatus according to claim 4, in which the comparison device is configured to compare the electrical signals representing the measured values of the undesirable particles detected at the open end of one fibre tuft to the electrical signals representing the measured values of the undesirable particles detected at the open end of the other fibre tuft to generate the comparison values.

6. An apparatus according to claim 1, in which the comparison device comprises an electronic evaluating device.

7. An apparatus according to claim 1, further comprising a computer.

8. An apparatus according to claim 1, wherein the detected undesirable particles comprise neps.

9. An apparatus according to claim 1, in which undesirable particle detection is effected on the basis of image-processing at the fibre tuft according to the number, shape and size of the particles.

10. An apparatus according to claim 1, in which the recognition device separately detects the undesirable particles on the open ends of the fibre tuft in the machine working direction and on the open ends of the fibre tuft in the opposite direction.

11. An apparatus according to claim 10, in which differences in the measured values of the fibre tufts are used for measured value analysis and/or fault location.

12. An apparatus according to claim 10, in which the measured values comprise count results of the undesirable particles of each fibre tuft and are associated causally with carding work of specific working elements of the one or more textile machines.

13. An apparatus according to claim 12, in which the undesirable particles are neps, and wherein the count results of the neps on a side of the fibre tuft having a predominant number of trailing hooks are associated causally with the carding work of revolving card top regions of the one or more textile machines.

14. An apparatus according to claim 12, wherein the count results relate to one or more of a setting of the working elements, clothing of the working elements and a state of wear of the clothing.

15. An apparatus according to claim 1, further comprising an electronic control and regulation device for receiving the comparison values and for generating an instruction for action in respect of the working elements of the one or more textile machines.

16. An apparatus according to claim 15, in which, when the measured values exceed a limit value, warning messages in respect of the working elements are displayed.

17. An apparatus according to claim 1, in which the textile machine is a spinning preparation machine.

18. An apparatus according to claim 1, in which the apparatus is associated with a fibre-sliver-forming device.

19. An appar atus for recognizing undesirable particles in textile fibre material processed on one or more textile machines, comprising:

a clamping receiving device comprising two clamping elements arranged to clamp a conveyed fibre sliver, wherein the clamping receiving device is moveably arranged on a guide element to detach a length of the fibre sliver;

a combing-out device comprising two combing rollers arranged to comb opposite ends of the detached length of fibre sliver to produce opposing fibre tufts having open ends;

a measuring device comprising:

a recognition device comprising an optoelectronic device moveable in a direction along the fibre sliver length, the recognition device being configured to detect undesirable particles in the open ends of the opposing fibre tufts and generate electrical signals representing measured values of the detected undesirable particles;

an image-processing unit configured to receive and process the electrical signals from the recognition device and generate the measured values; and a comparison device configured to receive the measured values from the image-processing unit, compare the measured values from the opposing fibre tufts, and generate comparison values; and an electronic control and regulation device arranged to receive the comparison values and generate an instruction to optimize setting parameters and/or working elements of the one or more textile machines.

* * * * *